US006532784B1

(12) United States Patent
Dunn et al.

(10) Patent No.: US 6,532,784 B1
(45) Date of Patent: Mar. 18, 2003

(54) MECHANICAL HYDROFORMING WITH IMPROVED LUBRICATION

(75) Inventors: Joseph A. Dunn, Sterling Heights, MI (US); William P. Warkentin, West Bloomfield, MI (US); Edward Elizondo, Rochester Hills, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/786,404

(22) PCT Filed: Sep. 2, 1999

(86) PCT No.: PCT/US99/18830

§ 371 (c)(1),
(2), (4) Date: Apr. 2, 2001

(87) PCT Pub. No.: WO00/13814

PCT Pub. Date: Mar. 16, 2000

(51) Int. Cl.[7] ..... B21D 9/15; C10M 137/00; F16L 9/147

(52) U.S. Cl. ..... 72/42; 72/58; 72/61

(58) Field of Search ..... 72/42, 43, 58, 72/57, 60, 61, 62; 138/146; 508/421

(56) References Cited

U.S. PATENT DOCUMENTS

| | | | | | |
|---|---|---|---|---|---|
| 3,769,824 | A | * | 11/1973 | Granzow | 72/350 |
| 4,051,704 | A | | 10/1977 | Kimura | |
| 4,305,269 | A | | 12/1981 | Kimura | |
| 4,390,436 | A | | 6/1983 | Hernandez | |
| 4,649,492 | A | | 3/1987 | Sinha et al. | |
| 5,246,507 | A | | 9/1993 | Kodama et al. | |
| 5,630,334 | A | | 5/1997 | Ash | |
| 5,783,530 | A | | 7/1998 | Foster et al. | |
| 5,837,658 | A | * | 11/1998 | Stork | 72/42 |
| 5,918,494 | A | | 7/1999 | Kojima et al. | |
| 6,006,567 | A | * | 12/1999 | Brown et al. | 72/57 |
| 6,009,913 | A | | 1/2000 | Kojima et al. | |
| 6,034,041 | A | * | 3/2000 | Nittel et al. | 72/42 |
| 6,255,260 | B1 | * | 6/2001 | Stork | 72/42 |
| 6,282,934 | B1 | * | 9/2001 | Bikert et al. | 72/58 |
| 6,286,351 | B1 | * | 9/2001 | Schulze | 72/60 |

* cited by examiner

*Primary Examiner*—David Jones
(74) *Attorney, Agent, or Firm*—Brooks & Kushman P.C.

(57) ABSTRACT

A process of mechanical hydroforming, in which a hollow tube is caused to expand against the interior surface of a die that surrounds the tube by hydraulic pressure applied to a liquid that fills the interior of the tube, is improved by coating the part of the exterior surface of the tube that comes into contact with the die surface against which it expands with a wax that is solid at normal room temperature but can be maintained fully melted and in contact with air, without showing any visible evidence of decomposition, at a temperature that is at least 75 degrees C. Preferably, the wax is applied to the surface to be hydroformed by spraying from melt onto the surface while the latter is maintained above the melt temperature of the wax. Shortly after the wax has been thus applied to the surface, the wax is cooled until it solidifies. Most preferably, the wax is an "oxidized hydrocarbon" wax that is about 95% hydrocarbon and 5% straight chain carboxylic acids and contains a wide variety of molecular weights of both hydrocarbons and carboxylic acids.

18 Claims, No Drawings

MECHANICAL HYDROFORMING WITH IMPROVED LUBRICATION

BACKGROUND OF THE INVENTION

This invention relates to a process known as "hydroforming", which is a relatively new process for cold shaping of ductile objects, usually metals. In this process, a hollow ductile object, which has a closed cross section and ends that are capable of being temporarily sealed so as to withstand internal pressure, such a hollow object being hereinafter denoted for brevity as a "tube"[1], is filled with a fluid and then shaped by hydraulic pressure applied to the fluid. In all instances of relevance to this invention, the object being hydroformed is surrounded by an openable die with an internal surface that has the same shape as is desired for the external surface of the hydroformed part of the hydroformed object upon completion of the hydroforming.

[1]Without thereby implying any additional limitation on the shape of the object.

In what is usually the first if not the sole stage of a hydroforming process, internal hydraulic pressure pushes the tube evenly into the die cavity, from an initial position in which the tube does not directly contact the inner surface of the die. As the tube expands, its ends are drawn inwardly along the longitudinal axis of the tube. The area of the tube that contacts the inner die surface first keys the tube at the point of contact. Because this prevents any further longitudinal movement, part of the remainder of the tube expands, with corresponding reduction of wall thickness, as the material elongates. An axial force is usually applied to the tube ends to control wall thinning during expansion, and by this means the end regions of the tube being hydroformed may be kept from undergoing any substantial wall thinning, as is usually preferred. Surface friction between the tube blank and the die has a significant influence on the axial force required for the process, because high surface friction can counteract the axial force. In other types or stages of hydroforming, contact between the tube being hydroformed and most or all of the inner die surface already exists at the beginning of the hydroforming. In such alternative types or stages of hydroforming, the degree of surface friction between the tube being hydroformed and the die strongly influences the quality of the results achieved from the beginning of the hydroforming.

Surface friction in hydroforming has conventionally been reduced by the use of highly compounded, very high viscosity liquid lubricants or by dry film lubricants primarily consisting of soaps and/or polymers. However, the lubricants previously known in the art for this process have substantial disadvantages: The liquid ones tend to become non-uniformly distributed in the die cavity, generating a likelihood, and often an actuality, of inadequate lubrication on some part of the surface where the lubricant layer is thinned too much. The dry film lubricants are readily degraded by contact with water, which usually constitutes a large major fraction of the preferred hydraulic fluid for use in hydroforming, so that contact between the dry lubricant and the water can not be easily avoided. Also, the prior art dry film lubricants are expensive and difficult to reuse, require a considerable input of heat energy to convert them within a practical time from the aqueous dispersion and/or solution from which they are normally applied to the solid form in which they are used, and are difficult to clean from the dies and/or the hydroformed tubes.

A major object of the invention is to overcome one or more of the difficulties described above with hydroforming lubricants taught in other art. Other alternative or concurrent objects are to provide less costly hydroforming operations and lubricants therefor and to provide superior quality hdyroformed tubes. Other objects will be apparent from the description below.

Except in the claims and the specific examples, or where otherwise expressly indicated, all numbers in this description indicating amounts of material or conditions of reaction and/or use are to be understood as modified by the word "about" in describing the broadest scope of the invention. Practice within the numerical limits stated is generally preferred, however. Also, throughout this specification, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, or as reduced or increased in amount in situ by chemical reactions explicitly stated in the description, and does not necessarily preclude unstated chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to any of the objects of the invention); and the term "mole" means "gram mole" and the term itself and its grammatical variations may be applied to elemental, ionic, unstable, hypothetical, and any other chemical species defined by number and type of atoms present, as well as to compounds with well defined molecules.

BRIEF SUMMARY OF THE INVENTION

It has been found that waxes provide a lubricating performance in hydroforming that is superior to that of any previously used lubricants for this purpose, particularly when applied in a preferred manner described in detail below.

DETAILED DESCRIPTION OF THE INVENTION

A process according to the invention for hydroforming a tube of a ductile solid material, said tube having an outer surface, an interior, and an interior surface, comprises, preferably consists essentially of, or more preferably consists of at least the following operations:

(I) providing an openable die having an interior surface of a shape to which it is desired to have the hydroformed part of the outer surface of the tube of ductile solid material conform after said tube has been hydroformed;

(II) forming, over at least such portion of the outer surface of the tube of ductile solid material as is intended to contact the interior surface of the openable die during hydroforming, a coating of a solid wax, so as to form a coated ductile tube;

(III) emplacing the coated ductile tube within at least a part of said openable die and closing the die, so that a portion of the outer surface of the ductile tube that is desired to be hydroformed is within the closed openable die;

(IV) providing within the interior of the tube of ductile solid a hydraulic fluid that exerts equal pressure on all parts of the internal surface of the tube of ductile solid with which the hydraulic fluid is in physical contact; and (V) applying to the hydraulic fluid provided in operation (IV) as described immediately above, while the ductile tube remains emplaced within the closed openable die as recited in operation (III) above, a sufficient pressure to cause at least a portion of the outer surface of the coated ductile tube to conform to the inner surface of the closed openable die.

For the purposes of this description, "wax" is defined as a substance that: (i) is a plastic solid at 25° C. under normal atmospheric pressure and (ii) can be maintained completely melted and in contact with the natural ambient atmosphere without visually evident decomposition at a temperature that is at least 75° C.

A wax often does not have a sharp melting point, probably because it is a mixture of chemically analogous materials of varying molecular weight. Accordingly, the melting characteristics of a wax are generally, and for the purposes of this description, measured by American Society for Testing and Materials (hereinafter usually abbreviated as "ASTM") Method D-127, which gives a "drop melting" temperature range. For a wax that is to be used as a lubricant in a process according to this invention, the lowest temperature in its drop melting range preferably is at least, with increasing preference in the order given, 40, 45, 50, 55, 60, 62, 64, or 66° C. and the highest temperature in its drop melting range independently preferably is not more than, with increasing preference in the order given, 95, 90, 85, 80, 75, 72, or 70° C.

Chemically, at least, with increasing preference in the order given, 50, 60, 70, 80, 85, 90, 95, or 99% of a wax to be used in a process according to this invention consists of one or more organic substances selected from the group consisting of hydrocarbons, halohydrocarbons, halocarbons, alcohols, ethers, carboxylic acids, esters of carboxylic acids, ketones, and aldehydes. More preferably, the organic substance is selected from molecules each of which contains at least one moiety that contains at least, with increasing preference in the order given, 8, 10, 12, 14, or 16 carbon atoms that are joined to one another, with no intervening atoms except optionally for fluorine, chlorine, and ether oxygen atoms, in a straight chain or a chain with no more than one branch.

Still more preferably, the predominant part as defined above of the wax for use in a process according to this invention is a mixture of (i) aliphatic hydrocarbon molecules and (ii) carboxylic acid molecules, in which the mole percent of hydrocarbons is at least, with increasing preference in the order given, 50, 65, 75, 80, 85, 87, 89, 91, or 93% of the total wax used and the mole percent of carboxylic acids independently preferably is at least, with increasing preference in the order given, 0.5, 1.0, 1.5, 2.0, 2.3, 2.6, 2.9, 3.2, 3.5, 3.8, 4.1, 4.3, 4.5, 4.7, or 4.9% of the total wax used. Moreover, the following preferences for carbon number distribution, each independently of the others, apply to the hydrocarbon portion of the wax: at least, with increasing preference in the order given, 25, 30, 33, 36, or 39 mole % of the molecules have from 26 to 33 carbon atoms each; at least, with increasing preference in the order given, 25, 30, 33, 36, 39, or 42 mole % of the molecules have from 21 to 25 carbon atoms each; at least, with increasing preference in the order given, 2.0, 2.5, 3.0, 3.5, 4.0, 4.5, or 5.0 mole % of the hydrocarbon molecules have each of the numbers of carbon atoms from 21 to 29; and at least, with increasing preference in the order given, 6.0, 7.0, 8.0, 8.5, 9.0, or 9.5 mole % of the hydrocarbon molecules have each of the numbers of carbon atoms from 22 to 25. Further and independently, the following preferences for the carbon number distribution, each independently of the others, apply to the carboxylic acid portion of the wax: at least, with increasing preference in the order given, 5, 10, 12, 14, or 16 mole % of the molecules have either 19 or 20 carbon atoms each; at least, with increasing preference in the order given, 10, 15, 20, 22, 24, 26, or 28 mole % of the molecules have from 14 to 18 carbon atoms each; at least, with increasing preference in the order given, 10, 15, 20, 22, 24, or 26 mole % of the molecules have from 8 to 13 carbon atoms each; at least, with increasing preference in the order given, 10, 15, 20, 22, 24, or 26 mole % of the molecules have 21 or more carbon atoms each; and at least, with increasing preference in the order given, 0.5, 1.0, 1.5, 2.0, 2.5, 3.0, 3.5, 4.0, or 4.5 mole % of the molecules have each of the numbers of carbon atoms from 11 to 24.

Waxes conforming to all of the preferences stated above are available commercially as "oxidized petroleum waxes", which are made by partial oxidation with air of a distillation fraction of selected types of petroleum. The distillate is believed to consist almost entirely of aliphatic, predominantly straight chain, hydrocarbon molecules, most of which are saturated but some of which are unsaturated. The partial oxidation process is believed to convert the originally unsaturated molecules to two molecules of carboxylic acids for each original carbon-carbon unsaturated bond. A very large fraction of the molecules that have unsaturation have only one unsaturated bond, so that almost all of the acids produced are believed to contain only one carboxylic acid moiety per molecule. The distribution of carbon atom numbers in the molecules of the wax can be readily determined by gas chromatography coupled with mass spectrometry, as generally known in the instrumental analytical chemistry art, after the acids have been converted to their corresponding methyl esters. (Details of the method used are given as part of the working examples, and are to be used if needed to determine conformance or non-conformance to the preferences stated above for carbon number distributions.)

The amount of carboxylic acids in the waxes used may also be characterized quantitatively overall by more traditional analytical methods, specifically a Saponification Number as measured by ASTM Method D-94 and an Acid Number as measured by ASTM Method D-974. A wax used in a process according to this invention preferably has, independently for each characteristic stated: (i) a Saponification Number that is at least, with increasing preference in the order given, 5, 10, 15, 20, 24, 26, 28, 30, 32, 34, 36, or 38 and independently preferably is not more than, with increasing preference in the order given, 100, 90, 80, 75, 70, 65, 60, 56, 54, 52, or 50; and (ii) an Acid Number that is at least, with increasing preference in the order given, 3, 5, 7, 9, 11, 13, 15, 17, or 19 and independently preferably is not more than, with increasing preference in the order given, 150, 100, 75, 50, 45, 40, 35, 32, 30, 28, or 26.

Preferred waxes for use in a process according to this invention may be further characterized by their viscosity when kept at a high enough temperature to be liquid. More specifically, independently for each temperature noted: the viscosity at 93° C. preferably is at least, with increasing preference in the order given, 3, 5, 10, 15, 20, 25, 28, 30, 32, or 34 centistokes and independently preferably is not more than, with increasing preference in the order given, 100, 80, 60, 55, 52, 49, 46, 44, 42, 40, 38, or 36 centistokes; at 88°

C., the viscosity preferably is at least, with increasing preference in the order given, 5, 10, 20, 30, 35, 40, 45, 50, 52, 54, 56, 58, 60, 62, 64, or 66 centistokes and independently preferably is not more than, with increasing preference in the order given, 300, 250, 200, 180, 160, 140, 120, 100, 95, 90, 85, 82, 79, 76, 74, 72, 70, or 68 centistokes; at 82° C. the viscosity preferably is at least, with increasing preference in the order given, 40, 60, 65, 70, 75, 80, 85, 90, 95, 100, 105, 110, 115, 120, 125, 130, 133, 136, 139, 143, or 145 centistokes and independently preferably is not more than, with increasing preference in the order given. 700, 500, 300, 250, 240, 230, 220, 210, 200, 195, 190, 185, 180, 175, 170, 165, 160, 155, or 150 centistokes; and at 77° C., the viscosity preferably is at least, with increasing preference in the order given, 50, 60, 70, 80, 90, 100, 110, 120, 130, 140, 150, 160, 170, 180, 185, 190, 195, 198, 201, 204, 205, or 208 centistokes and independently preferably is not more than, with increasing preference in the order given, 1500, 1000, 750, 500, 450, 400, 350, 300, 290, 280, 275, 270, 265, 260, 255, 250, 245, 240, 235, 230, 227, 224, 221, 218, 215, or 212 centistokes.

The coating of wax required in a process according to the invention preferably is formed over the outer surface of the ductile tube to be hydroformed by application of the wax in liquid form, most preferably from a melt of the wax itself, but suitably also from a solution, dispersion, or both solution and dispersion of the wax in a liquid solvent/dispersion medium. Spraying of melted wax is particularly preferred, with airless spraying most preferred. The melted wax when used is preferably maintained in the reservoir from which it is sprayed at a temperature that is at least, with increasing preference in the order given, 20, 30, 35, 40, 43, 46, 49, 51, 53, or 55° C. higher than the lower end of the drop melting range of the wax used and independently preferably is not more than, with increasing preference in the order given, 100, 75, 70, 65, 60, or 57° C. higher than the lower end of the drop melting range of the wax used.

In order to facilitate formation of a substantially uniform coating, the outer surface of the ductile tube to be hydroformed is preferably brought to a temperature that is at least, with increasing preference in the order given, 4.0, 6.0, 8.0, 10, 12, 14, or 16° C. above the lower end of the drop melting range of the wax used and independently preferably is not more than, with increasing preference in the order given, 60, 50, 45, 40, 35, 32, 29, or 27° C. above the lower end of the drop melting range of the wax used. This temperature for the substrate to be coated may be achieved by any heating means known in the art, such as infrared radiant heating, a convection oven, and heat lamps.

For convenience and efficiency, it is often preferred to accomplish the coating of the substrates continuously. This may conveniently be achieved by using in succession a heating stage for the substrate and a spray application of melted wax as described above, optionally followed by a cooling stage. The latter is not technically required in a process but is often convenient, because after the wax coating has been cooled at least 11° C. below the lower end of the drop melting temperature of the wax, the coated substrates may be safely nested or otherwise brought into contact with one another to facilitate efficient storage. The use of one or more air knives has been found to be highly suitable for rapid cooling in a continuous processing operation of this type, but other known cooling means could of course also be used. Melted wax oversprayed during the spray coating operation can readily be collected and reused, providing another economic advantage of a process according to the invention compared with prior art processes.

The coating of wax on the ductile tube to be formed preferably has a coefficient of sliding friction, against the material of the inner surface of the openable die used in a process according to the invention, that is not more than, with increasing preference in the order given, 0.30, 0.25, 0.20, 0.17, 0.14, 0.11, 0.090, 0.070, 0.050, 0.045, 0.040, or 0.038. The value of the coefficient of friction may suitably be measured under a perpendicular force of 100±5 bars.

Only a relatively thin layer of the wax is needed for satisfactory lubrication. More particularly, the average thickness of the wax layer formed before hydroforming begins preferably is at least, with increasing preference in the order given, 0.2, 0.4, 0.6, 0.8, 1.0, 1.2, 1.4, 1.6, 1.8, 2.0, 2.2, or 2.4 micrometers (hereinafter usually abbreviated as "μm") and independently, primarily for reasons of economy, preferably is not more than, with increasing preference in the order given, 200, 100, 75, 50, 45, 40, 35, 30, or 25 μm and, unless the surface of the substrate being hydroformed is exceptionally rough and/or very high hydroforming pressures are used, still more preferably is not more than, with increasing preference in the order given, 20, 15, 10, 8, 6, 5.0, 4.5, 4.0, 3.5, or 3.0 μm. The thickness can be determined conveniently by use of a conventional paint film thickness gauge such as an ELCOMETER™ Model 345F/N gauge made by Elcometer Instruments, Ltd. Uniformity of the thickness of the coating formed can normally be adequately judged visually: If the coating has no thickness variations visible on careful examination with unaided normal human vision, it is adequately uniform for the purposes of this invention.

Preferred waxes for use according to the invention can be readily removed from surfaces of metal ductile tubes, after hydroforming is completed, by conventional alkaline cleaners. If the hydroformed object is to be welded, either the wax should first be cleaned from the surface to be welded, or shielded welding wire should be used. If unshielded welding wire is used without removing the lubricating wax, severe smoke output during welding and/or porosity in the weld metal itself that compromises the strength and integrity of the weld is likely.

Except for use of the characteristic lubricant for this invention as described above, the process conditions for a hydroforming process according to the invention are normally the same as those already in use in the art. A process according to the invention is particularly advantageous in "high pressure" hydroforming, in which the hydraulic pressure in step (V) of the process as described above is at least 340 bars.

The invention may be further appreciated by consideration of the following examples and comparison examples.

EXAMPLES AND COMPARISON EXAMPLES

Coefficient of Friction Measurements

For these examples and comparison examples, flat panels of a metal of uncertain composition (possibly hot rolled steel) that at least one commercial manufacturer is reported to be interested in hydroforming were coated with one of the following products: GLEITMO™ lubricant, a product of the D. A. Stuart Co. that is now in commercial use for hydroforming; POLYDRAW® 812M (hereinafter usually abbreviated as "812M") and BONDERLUBE® 234 (hereinafter usually abbreviated as "234") concentrates, both commercial products available from the Henkel Surface Technologies Division of Henkel Corporation, Madison Heights, Mich. that are recommended for conventional cold working operations in which tubular workpieces, without any use of internal hydraulic pressure, are elongated and reduced in wall thickness and cross-sectional area; and ALOX® 2289 Acid Fume Rust Preventive Additive (hereinafter usually abbreviated as "2289"), a commercial product of the Alox Corporation, Niagara Falls, N.Y., which is reported by its supplier to be "an oxygenated compound, produced by the partial oxidation of aliphatic petroleum fractions, blended with a minor amount of sodium petroleum sulfonate" and is a brown waxy solid. The other three products noted above do not or are not believed to contain any similar waxes. All of these materials except 2289 are supplied as liquids, which were coated with a draw bar to a thickness of about 3 $\mu$m; the 812M and 234 materials were then dried at a temperature of 121° C., as recommended by their manufacturer before use. The Alox material was melted and drawn in melted form. All the coated panels were then cooled to normal ambient temperature of 22±5° C. before beginning the coefficient of friction measurements.

The measurements of frictional force were made on a draw bench equipped to provide a continuous recording of the force required to draw a standard platen across the panel while the platen is pressed against the coated test panel under a perpendicular force of 103 bars. The average pulling force is divided by the perpendicular force to give the coefficient of sliding friction. The results are shown in Table 1 below.

TABLE 1

| Lubricant | Coefficient of Sliding Friction |
|---|---|
| GLEITMO | 0.15 |
| 812M | 0.25 |
| 234 | 0.19 |
| 2289 | 0.037 |

DETAILED DESCRIPTION OF A PREFERRED WAX LUBRICANT FOR USE ACCORDING TO THE INVENTION

The wax used was ALOXDRAW™ 2420 wax, commercially supplied by Alox Corporation, Niagara Falls, N.Y. A sample of it was first examined by Fourier-transform infrared spectroscopy, which indicated that it was composed almost exclusively of hydrocarbons and carboxylic acids. Another sample was then treated with a solution of boron trichloride in methanol, a reagent known to convert carboxylic acids into their corresponding methyl esters and not to react with hydrocarbons. The hydrocarbons and esters were then extracted from the methanol solution with petroleum ether solvent, and this solution was analyzed by gas chromatography through a 30 meter long column with an inside diameter of 0.25 millimeter and DB5 packing with a film thickness of 0.5 $\mu$m, coupled to a mass spectrometer with an ionization potential of 70 electron volts as its detector. The injector port of the gas chromatograph was at 275° C.; the carrier gas was helium at a flow of 1.1 milliliters per minute; the column temperature was initially 60 ° C. and began to be raised immediately upon injection of the sample at a controlled rate of 10° C. until a final column temperature of 340° C. was reached; the column was then kept at that temperature for an additional 20 minutes.

The mass spectrometer gave as one of its outputs an integrated area under each chromatographic peak; these integrated areas are generally known to correspond to numbers of molecules ionized, and the ionization potentials of hydrocarbons and the methyl esters of carboxylic acids are known to be sufficiently close to one another that the relative fraction of ionized molecules quantitatively measures the relative traction of total molecules within an accuracy of not more than 3% deviation from the true value. The total mole fraction of methyl esters, corresponding to original carboxylic acids, was determined in this manner to be 5.0%, with the balance of 95% being hydrocarbons. The percentage distribution of various chain lengths among the acids and hydrocarbons, separately for each, is shown in Table 2 below.

TABLE 2

| Number of Carbon Atoms per molecule | Percentage of Molecules with This Number of Carbon Atoms for: Hydrocarbons | Acids |
|---|---|---|
| 6 | not determined (Note 1) | 1.7 |
| 7 | not determined (Note 1) | 2.2 |
| 8 | not determined (Note 1) | 4.5 |
| 9 | not determined (Note 1) | 3.7 |
| 10 | not determined (Note 1) | 4.0 |
| 11 | <0.1 | 4.5 |
| 12 | <0.1 | 5.1 |
| 13 | <0.1 | 5.1 |
| 14 | not determined (Note 2) | 5.8 |
| 15 | 0.2 | 6.0 |
| 16 | 0.2 | 6.1 |
| 17 | 0.2 | 5.9 |
| 18 | 0.5 | 5.9 |
| 19 | 1.3 | 8.9 |
| 20 | 2.6 | 8.5 |
| 21 | 6.0 | 5.5 |
| 22 | 10.5 | 6.2 |
| 23 | 12.3 | 5.1 |
| 24 | 11.4 | 4.8 |
| 25 | 10.5 | not determined (Note 2) |
| 26 | 8.8 | not determined (Note 1) |
| 27 | 7.4 | not determined (Note 1) |
| 28 | 6.2 | not determined (Note 1) |
| 29 | 5.5 | not determined (Note 1) |
| 30 | 4.1 | not determined (Note 1) |
| 31 | 3.5 | not determined (Note 1) |
| 32 | 2.5 | not determined (Note 1) |
| 33 | 2.1 | not determined (Note 1) |
| 34 | 1.5 | not determined (Note 1) |
| 35 | 0.8 | not determined (Note 1) |
| 36 | 0.5 | not determined (Note 1) |
| 37 | 0.8 | not determined (Note 1) |
| 38 | not determined (Note 2) | not determined (Note 1) |

Notes for Table 2
Note 1: The expected mass values for the hydrocarbon or acid with this carbon number are outside the range of the equipment used.
Note 2: For this carbon number, there was interference by material bleeding from the gas chromatography column.

What is claimed is:

1. A process for hydroforming a tube of a ductile solid material, said tube having an outer surface, an interior, and an interior surface, said process comprising operations of:

(I) providing an openable die having an interior surface of a shape to which it is desired to have the hydroformed part of the outer surface of the tube of ductile solid material conform after said tube has been hydroformed;

(II) forming, over at least such portion of the outer surface of the tube of ductile solid material as is intended to contact the interior surface of the openable die during hydroforming, a coating of a solid wax, so as to form a coated tube of ductile solid material;

(III) emplacing the coated tube of ductile solid material within at least a part of said openable die and closing the die, so that a portion of the outer surface of the coated tube of ductile solid material that is desired to be hydroformed is within the closed openable die;

(IV) providing within the interior of the coated tube of ductile solid material a hydraulic fluid that exerts equal pressure on all parts of the internal surface of the coated tube of ductile solid material with which the hydraulic fluid is in physical contact; and (V) applying the hydraulic fluid provided in operation (IV) as described immediately above, while the coated tube of ductile solid material remains emplaced within the closed openable die as recited in operation (III) above, a sufficient pressure to cause at least a portion of the outer surface of the coated tube of ductile solid material to conform to the inner surface of the closed openable die, wherein operation (II) is accomplished by spraying melted wax that is maintained at a temperature at least about 20° C. higher than the lower end of the drop melting range of the wax onto the outer surface of the tube of ductile solid material.

2. A process according to claim 1, wherein operation (II) is accomplished by maintaining the temperature of the outer surface of the tube of ductile solid material at a temperature at least about 4° C. above the lower end of the drop melting range of the wax, and the liquid coating of wax thus formed is subsequently cooled sufficiently to cause the wax to solidify.

3. A process according to claim 2, wherein the solid coating of wax formed in operation (II) has a thickness of at least about 1.0 $\mu$m.

4. A process according to claim 3, wherein said wax has a drop melting range in which the lowest temperature is at least about 50° C. and the highest temperature is not more than about 80° C.

5. A process according to claim 4, wherein said sufficient pressure applied in operation (V) is at least about 340 bars.

6. A process according to claim 2, wherein said sufficient pressure applied in operation (V) is at least about 340 bars.

7. A process according to claim 1, wherein the solid coating of wax formed in operation (II) has a thickness of at least about 1.0 $\mu$m.

8. A process according to claim 7, wherein said wax has a drop melting range in which the lowest temperature is at least about 50° C. and the highest temperature is not more than about 80° C.

9. A process according to claim 8, wherein said sufficient pressure applied in operation (V) is at least about 340 bars.

10. A process according to claim 1 wherein at least about 50% of said wax is selected from the group consisting of hydrocarbons, halohydrocarbons, halocarbons, alcohols, ethers, carboxylic acids, esters of carboxylic acids, ketones, and aldehydes.

11. A process according to claim 10 wherein said wax is selected from molecules each of which contains at least one moiety that contains at least eight carbon atoms that are joined to one another, with no intervening atoms except optionally for fluorine, chlorine, and ether oxygen atoms, in a straight chain or in a chain with no more than one branch.

12. A process according to claim 11 wherein the mole percent of hydrocarbons is at least about 50% of the total wax used and the mole percent of carboxylic acids is. at least about 0.5% of the total wax used.

13. A process according to claim 12 wherein:

for the hydrocarbon molecules:

at least about 25 mole % of the molecules have from 26 to 33 carbon atoms each;

at least about 25 mole % of the molecules have from 21 to 25 carbon atoms each;

at least about 2.0 mole % have each of the numbers of carbon atoms from 21 to 29; and at least about 6.0 mole % of the molecules have each of the numbers of carbon atoms from 22 to 25; and for the carboxylic acid molecules:

at least about 5 mole % of the molecules have either 19 or 20 carbon atoms each;

at least about 10 mole % of the molecules have from 14 to 18 carbon atoms each;

at least about 10 mole % of the molecules have from 8 to 13 carbon atoms each;

at least about 10 mole % of the molecules have 21 or more carbon atoms each; and at least about 0.5 mole % of the molecules have each of the numbers of carbon atoms from 11 to 24.

14. A process for hydroforming a tube of a ductile solid material, said tube having an outer surface, an interior, and an interior surface, said process comprising operations of:

(I) providing an openable die having an interior surface of a shape to which it is desired to have the hydroformed part of the outer surface of the tube of ductile solid material conform after said tube has been hydroformed;

(II) forming, over at least such portion of the outer surface of the tube of ductile solid material as is intended to contact the interior surface of the openable die during hydroforming, a coating of a solid wax, so as to form a coated tube of ductile solid material;

(III) emplacing the coated tube of ductile solid material within at least a part of said openable die and closing the die, so that a portion of the outer surface of the coated tube of ductile solid material that is desired to be hydroformed is within the closed openable die;

(IV) providing within the interior of the coated tube of ductile solid material a hydraulic fluid that exerts equal pressure on all parts of the internal surface of the coated tube of ductile solid material with which the hydraulic fluid is in physical contact; and (V) applying the hydraulic fluid provided in operation (IV) as described immediately above, while the coated tube of ductile solid material remains emplaced within the closed openable die as recited in operation (III) above, a sufficient pressure to cause at least a portion of the outer surface of the coated tube of ductile solid material to conform to the inner surface of the closed openable die;

wherein said wax has a drop melting range in which the lowest temperature is at least about 40° C. and the highest temperature is not more than about 95° C.

15. A process for hydroforming a tube of a ductile solid material, said tube having an outer surface, an interior, and an interior surface, said process comprising operations of:

(I) providing an openable die having an interior surface of a shape to which it is desired to have the hydroformed part of the outer surface of the tube of ductile solid material conform after said tube has been hydroformed;

(II) forming, over at least such portion of the outer surface of the tube of ductile solid material as is intended to contact the interior surface of the openable die during hydroforming, a coating of a solid wax, so as to form a coated tube of ductile solid material;

(III) emplacing the coated tube of ductile solid material within at least a part of said openable die and closing the die, so that a portion of the outer surface of the coated tube of ductile solid material that is desired to be hydroformed is within the closed openable die;

(IV) providing within the interior of the coated tube of ductile solid material a hydraulic fluid that exerts equal pressure on all parts of the internal surface of the coated tube of ductile solid material with which the hydraulic fluid is in physical contact; and (V) applying the hydraulic fluid provided in operation (IV) as described immediately above, while the coated tube of ductile solid material remains emplaced within the closed openable die as recited in operation (III) above, a sufficient pressure to cause at least a portion of the outer surface of the coated tube of ductile solid material to conform to the inner surface of the closed openable die;

wherein said wax comprises at least about 50 mole percent of hydrocarbons based on the total wax used and at least about 0.5 mole percent of carboxylic acids based on the total wax used.

16. A process according to claim 15 wherein at least about 50% of said wax is selected from the group consisting of hydrocarbons, halohydrocarbons, halocarbons, alcohols, ethers, carboxylic acids, esters of carboxylic acids, ketones, and aldehydes.

17. A process according to claim 16 wherein said wax is selected from molecules each of which contains at least one moiety that contains at least eight carbon atoms that are joined to one another, with no intervening atoms except optionally for fluorine, chlorine, and ether oxygen atoms, in a straight chain or in a chain with no more than one branch.

18. A process according to claim 17 wherein:

for the hydrocarbon molecules:

at least about 25 mole % of the molecules have from 26 to 33 carbon atoms each;

at least about 25 mole % of the molecules have from 21 to 25 carbon atoms each;

at least about 2.0 mole % have each of the numbers of carbon atoms from 21 to 29; and at least about 6.0 mole % of the molecules have each of the numbers of carbon atoms from 22 to 25; and for the carboxylic acid molecules:

at least about 5 mole % of the molecules have either 19 or 20 carbon atoms each;

at least about 10 mole % of the molecules have from 14 to 18 carbon atoms each;

at least about 10 mole % of the molecules have from 8 to 13 carbon atoms each;

at least about 10 mole % of the molecules have 21 or more carbon atoms each; and at least about 0.5 mole % of the molecules have each of the numbers of carbon atoms from 11 to 24.

* * * * *

UNITED STATES PATENT AND TRADEMARK OFFICE

CERTIFICATE OF CORRECTION

PATENT NO. : 6,532,784 B1 
DATED : March 18, 2003
INVENTOR(S) : Joseph A. Dunn, William P. Warkentin and Edward Elizondo It is certified that error appears in the above-identified patent and that said Letters Patent is hereby corrected as shown below:

Column 1,
Line 3, after the title "MECHANICAL HYDROFORMING WITH IMPROVED LUBRICATION" insert -- This application is the National Stage of International Application No. PCT/US99/18830, filed September 2, 1999, entitled "MECHANICAL HYDROFORMING WITH IMPROVED LUBRICATION", which claims the benefit of U.S. Provisional Application 60/099,187, filed September 4, 1998. --

Signed and Sealed this

Thirtieth Day of December, 2003

JAMES E. ROGAN
*Director of the United States Patent and Trademark Office*